US011691853B2

(12) United States Patent
Schmidt et al.

(10) Patent No.: US 11,691,853 B2
(45) Date of Patent: Jul. 4, 2023

(54) ESCALATOR WITH DISTRIBUTED STATE SENSORS

(71) Applicant: Otis Elevator Company, Farmington, CT (US)

(72) Inventors: Walter Thomas Schmidt, Marlborough, CT (US); Paul R. Braunwart, Hebron, CT (US); Enrico Manes, Feeding Hills, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/883,347

(22) Filed: May 26, 2020

(65) Prior Publication Data

US 2021/0371248 A1 Dec. 2, 2021

(51) Int. Cl.

| | |
|---|---|
| ***B66B 25/00*** | (2006.01) |
| ***B66B 23/12*** | (2006.01) |
| ***B66B 21/02*** | (2006.01) |
| ***G07C 5/00*** | (2006.01) |

(52) U.S. Cl.

CPC ..... *B66B 25/003* (2013.01); *B66B 21/02* (2013.01); *B66B 23/12* (2013.01); *B66B 25/006* (2013.01); *G07C 5/006* (2013.01)

(58) Field of Classification Search

CPC ..... B66B 25/003; B66B 21/02; B66B 23/12; B66B 25/006; B66B 1/02; B66B 23/24; B66B 29/00

See application file for complete search history.

(56) References Cited

U.S. PATENT DOCUMENTS

| | | | | |
|---|---|---|---|---|
| 6,601,688 | B1 | 8/2003 | Stoxen | |
| 9,878,883 | B2 * | 1/2018 | Nelson | B66B 29/00 |
| 10,071,884 | B2 * | 9/2018 | Li | B66B 21/02 |
| 10,294,081 | B2 * | 5/2019 | Wang | B66B 29/00 |
| 10,315,782 | B2 * | 6/2019 | Guajardo | B64F 1/315 |
| 10,392,230 | B2 * | 8/2019 | Qi | B66B 29/005 |
| 11,577,937 | B2 * | 2/2023 | Novacek | B66B 5/0025 |
| 2018/0208441 | A1 * | 7/2018 | Yamada | B66B 25/006 |
| 2021/0016999 | A1 * | 1/2021 | Wenlin | B66B 1/32 |
| 2021/0080139 | A1 * | 3/2021 | Brown | F24F 11/38 |
| 2021/0087021 | A1 * | 3/2021 | Novacek | G07C 5/006 |
| 2021/0276832 | A1 * | 9/2021 | Brestensky | B66B 25/006 |

FOREIGN PATENT DOCUMENTS

| | | | |
|---|---|---|---|
| CA | 3105141 | A1 | 1/2020 |
| EP | 3609205 | A1 | 2/2020 |
| WO | 2018028989 | A1 | 2/2018 |

OTHER PUBLICATIONS

European Search Report Issued in European Application No. 20215600.6-1017 dated Jun. 9, 2021; 7 Pages.

* cited by examiner

*Primary Examiner* — Gene O Crawford
*Assistant Examiner* — Lester Rushin, III
(74) *Attorney, Agent, or Firm* — Cantor Colburn LLP

(57) ABSTRACT

Disclosed is an escalator system having: escalator steps; and a plurality of state sensors including a master sensor and slave sensors, wherein the slave sensors are secured to different ones of the escalator steps, wherein the master sensor is configured to: receive slave sensor data from the slave sensors; and transmit data to an escalator call center upon detecting an occurrence of a fault condition from the slave sensor data.

12 Claims, 3 Drawing Sheets

ESCALATOR WITH DISTRIBUTED STATE SENSORS

BACKGROUND

The disclosed embodiments relate to escalators and more specifically to escalator equipped with distributed state sensors.

Escalator service contracts may rely heavily upon maintenance performed at regularly scheduled intervals. Despite scheduled maintenance, unplanned faults occur, leading to system downtime. Mechanics must identify faults, often without information related to faulted component or location. This lack of information may increase an occurrence and duration of system downtimes.

BRIEF DESCRIPTION

Disclosed is an escalator system including: escalator steps; and a plurality of state sensors including a master sensor and slave sensors, wherein the slave sensors are secured to different ones of the escalator steps, wherein the master sensor is configured to: receive slave sensor data from the slave sensors; and transmit data to an escalator call center upon detecting an occurrence of a fault condition from the slave sensor data.

In addition to one or more of the above disclosed features of the system or as an alternate, one or more of the slave sensors determines one or more of a physical state of the escalator, an operational state of the escalator, and a location of the fault condition along the escalator, and includes the determination in the slave sensor data; or the master sensor determines one or more of a physical state of the escalator, an operational state of the escalator, and a location of the fault condition along the escalator, and includes the determination in the data.

In addition to one or more of the above disclosed features of the system or as an alternate, the master sensor transits the data to the escalator call center via a cloud service, and the cloud service determines from the data one or more of a physical state of the escalator, an operational state of the escalator, and a location of the fault condition along the escalator.

In addition to one or more of the above disclosed features of the system or as an alternate, the slave sensors transmit, as slave sensor data, raw or filtered sensor data; and/or the master sensor transmits, as the data, a raw form of the slave sensor data.

In addition to one or more of the above disclosed features of the system or as an alternate, the slave sensors transmit filtered sensor data as the slave sensor data, wherein the filtered sensor data is filtered to only include sensor data above and/or below predetermined peaks.

In addition to one or more of the above disclosed features of the system or as an alternate, the master sensor is secured to one of the escalator steps or secured to a fixed location on or near the escalator.

In addition to one or more of the above disclosed features of the system or as an alternate, the master sensor is secured to a fixed location on or near the escalator and communicates with individual ones of the slave sensors that are within a predetermined distance of the master sensor.

In addition to one or more of the above disclosed features of the system or as an alternate, the master sensor and/or escalator call center is configured to: determine from sensor latency in transmissions from the slave sensors the occurrence of the fault condition.

In addition to one or more of the above disclosed features of the system or as an alternate, the plurality of state sensors include one or more of an accelerometer, a strain gage, a video camera, and a microphone.

In addition to one or more of the above disclosed features of the system or as an alternate, the master sensor is configured to communicate with the slave sensors over a first network that is a wireless network and communicate with the escalator call center over a second network that differs from the first network.

Disclosed is a method of monitoring an escalator system including: receiving, by a master sensor of a plurality of state sensors, slave sensor data from slave sensors of the plurality of state sensors, wherein the slave sensors are secured to different ones of escalator steps of an escalator; and transmitting, by the master sensor, a data to an escalator call center upon detecting an occurrence of a fault condition from the slave sensor data.

In addition to one or more of the above disclosed features of the method or as an alternate, the method includes one or more of the slave sensors determining one or more of a physical state of the escalator, an operational state of the escalator, and a location of the fault condition along the escalator, and includes the determination in the slave sensor data; or the master sensor determining one or more of a physical state of the escalator, an operational state of the escalator, and a location of the fault condition along the escalator, and includes the determination in the data.

In addition to one or more of the above disclosed features of the method or as an alternate, the method includes the master sensor transiting the data to the escalator call center via a cloud service, and the cloud service determining from the data one or more of a physical state of the escalator, an operational state of the escalator, and a location of the fault condition along the escalator.

In addition to one or more of the above disclosed features of the method or as an alternate, the method includes the slave sensors transmitting, as slave sensor data, raw or filtered sensor data; and/or the master sensor transmitting, as the data, a raw form of the slave sensor data.

In addition to one or more of the above disclosed features of the method or as an alternate, the method includes the slave sensors transmitting filtered sensor data as the slave sensor data, wherein the filtered sensor data is filtered to only include sensor data above and/or below predetermined peaks.

In addition to one or more of the above disclosed features of the method or as an alternate, the master sensor is secured to one of the escalator steps or secured to a fixed location on or near the escalator.

In addition to one or more of the above disclosed features of the method or as an alternate, the master sensor is secured to a fixed location on or near the escalator; and the method includes the master sensor communicating with individual ones of the slave sensors that are within a predetermined distance of the master sensor.

In addition to one or more of the above disclosed features of the method or as an alternate, the method includes the master sensor and/or escalator call center determining from sensor latency in transmissions from the slave sensors the occurrence of the fault condition.

In addition to one or more of the above disclosed features of the method or as an alternate, the plurality of state sensors include one or more of an accelerometer, a strain gage, a video camera, and a microphone.

In addition to one or more of the above disclosed features of the method or as an alternate, the method includes the master sensor communicating with the slave sensors over a first network that is a wireless network and communicating with the escalator call center over a second network that differs from the first network.

DESCRIPTION OF THE DRAWINGS

In the following an exemplary embodiment of the invention is described with reference to the enclosed figures.

DETAILED DESCRIPTION

A detailed description of one or more embodiments of the disclosed apparatus and method are presented herein by way of exemplification and not limitation with reference to the Figures.

Figure 1:
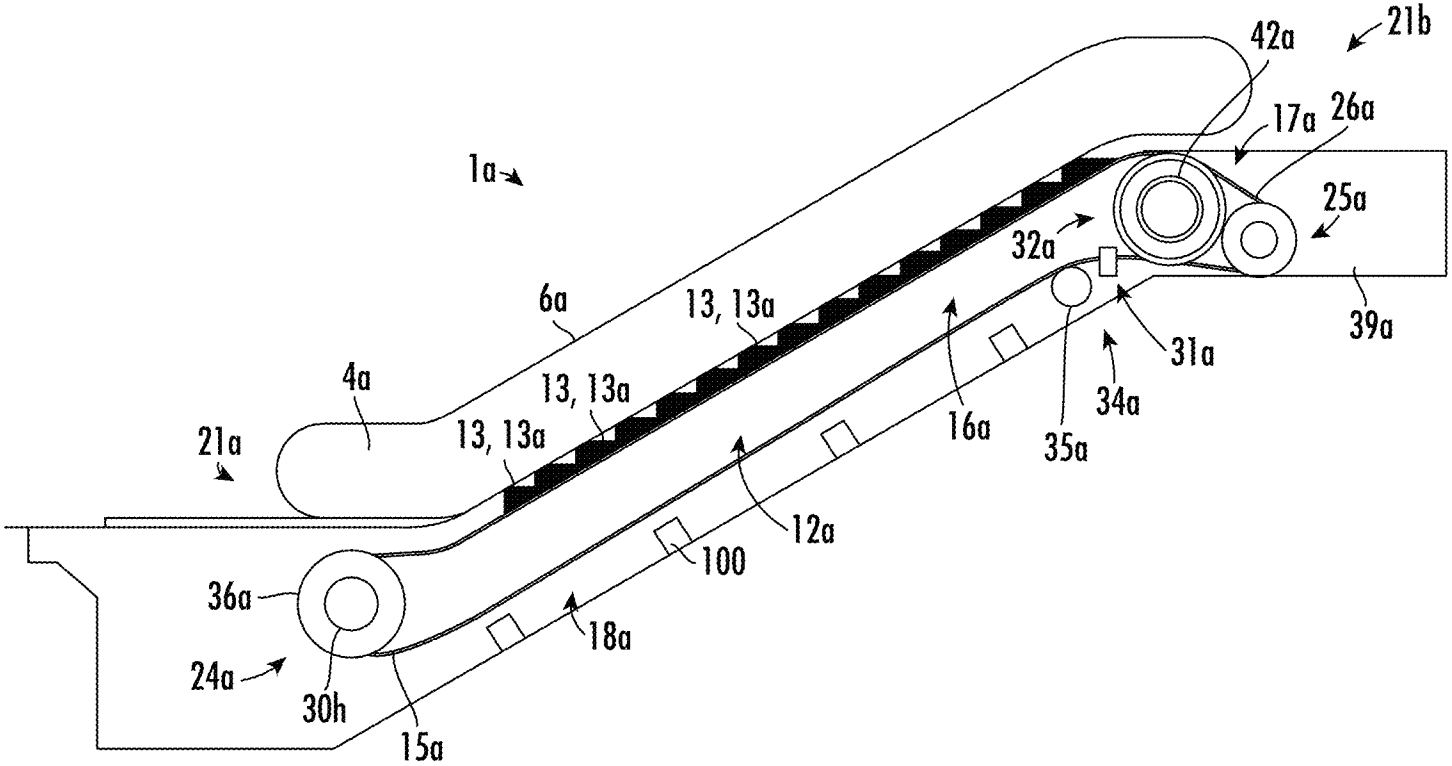
FIG. 1 is a schematic diagram showing a side view of an escalator system that may utilized features of the disclosed embodiments.

FIG. 1 shows a schematic side view of a people conveyor, in particular an escalator 1*a*, comprising a plurality of treads 13 (steps 13*a*) interconnected to form an endless tread band 12*a* extending in a longitudinal conveyance direction between a lower landing 21*a* and an upper landing 21*b*. For clarity, only some of the treads 13, in particular treads 13 in the conveyance portion 16*a*, are depicted in FIG. 1. Further, not all treads 13 are denoted with reference signs.

In an upper turnaround portion 17*a* next to the upper landing 21*a* and in a lower turnaround portion 24*a* next to the lower landing 20*a*, the endless tread band 12*a* passes from a conveyance portion 16*a* extending between the upper and lower landings 21*b*, 21*a* into a return portion 18*a*, and vice versa.

The upper turnaround portion 17*a* is a driving portion and comprises a tension member drive system 25*a*. The tension member drive system 25*a* comprises a motor driving a drive shaft 42*a* via a transmission element 26*a*, particularly a toothed belt, a belt or a chain. The drive shaft 42*a* supports a drive wheel 32*a*, e.g. a toothed belt drive sheave, a traction sheave or a sprocket.

The drive shaft 42*a* drivingly engages an endless tread drive tension member 15*a*. The endless tread drive tension member 15*a* may be a belt, particularly a toothed belt, or a chain. The endless tread drive tension member 15*a* is drivingly coupled to the treads 13 and thereby drives the treads 13 to travel along the endless path of the tread band 12*a*. The endless tread drive tension member 15*a* is endless and thus extends along a closed loop. The endless tread drive tension member 15*a* is in engagement with, and driven by, the drive wheel 32*a* supported by the drive shaft 42*a*.

The lower turnaround portion 24*a* comprises a turnaround element 36*a*, e.g. an idler wheel or an idler sprocket attached to a turnaround shaft 30*h*. The turnaround element 36*a* engages with the endless tread drive tension member 15*a* to guide the endless tread drive tension member 15*a* from the conveyance portion 16*a* to the return portion 18*a*.

In a tension portion 34*a* the endless tread drive tension member 15*a* engages a tension shaft 35*a* having a tension element, e.g. an idler sprocket or an idler wheel. The tension element is configured to adjust tension of the endless tread drive tension member 15*a* while traveling along its endless path, such that wear of the endless tread drive tension member 15*a* is reduced. For example, the tension portion 34*a* may be positioned in the return portion 18*a*.

In further embodiments, the tension portion 34*a* may be located in the upper and/or lower turnaround portions 17*a*, 24*a*. In such case, the upper/lower turnaround shaft may also provide the function of the tension shaft.

Alternatively, the turnaround portion 24*a* next to the lower landing 21*a* may be the driving portion.

The people conveyor 1*a* further comprises a brake 31*a* which is configured for braking movement of the endless tread band 12*a*. The brake 31*a* is depicted as a separate component of the tension member drive system 25*a* in FIG. 1. The brake 31*a*, however, may be integrated with another component of the tension member drive system 25*a*. For example, the brake 31*a* may engage with the drive wheel 32*a* or the drive shaft 42*a*.

Balustrades 4*a* supporting moving handrails 6*a* extend parallel to the conveyance portion 16*a*. The balustrades 4*a* are each supported by a separate truss 39*a*. Only one of the balustrades 4*a*, and the trusses 39*a* are visible in the side view shown in FIG. 1. The trusses 39*a* are connected to each other by one or more crossbeams 100 forming a connecting structure. The crossbeams 100 may comprise different profiles, for example, a rectangular, a triangular, or a circular profile. The crossbeams 100 are fixed to the trusses 39*a* by a detachable connection, such as by at least one bolt or screw, or by a fixed connection, such as by at least one weld. The crossbeams 100 are positioned under the endless tread band 12*a* and the endless tread drive tension member 15*a*. This allows easy removal of the endless tread drive tension member 15*a* during maintenance or repair, since the endless tread drive tension member 15*a* does not have to be opened.

Figures 2A, 2B:
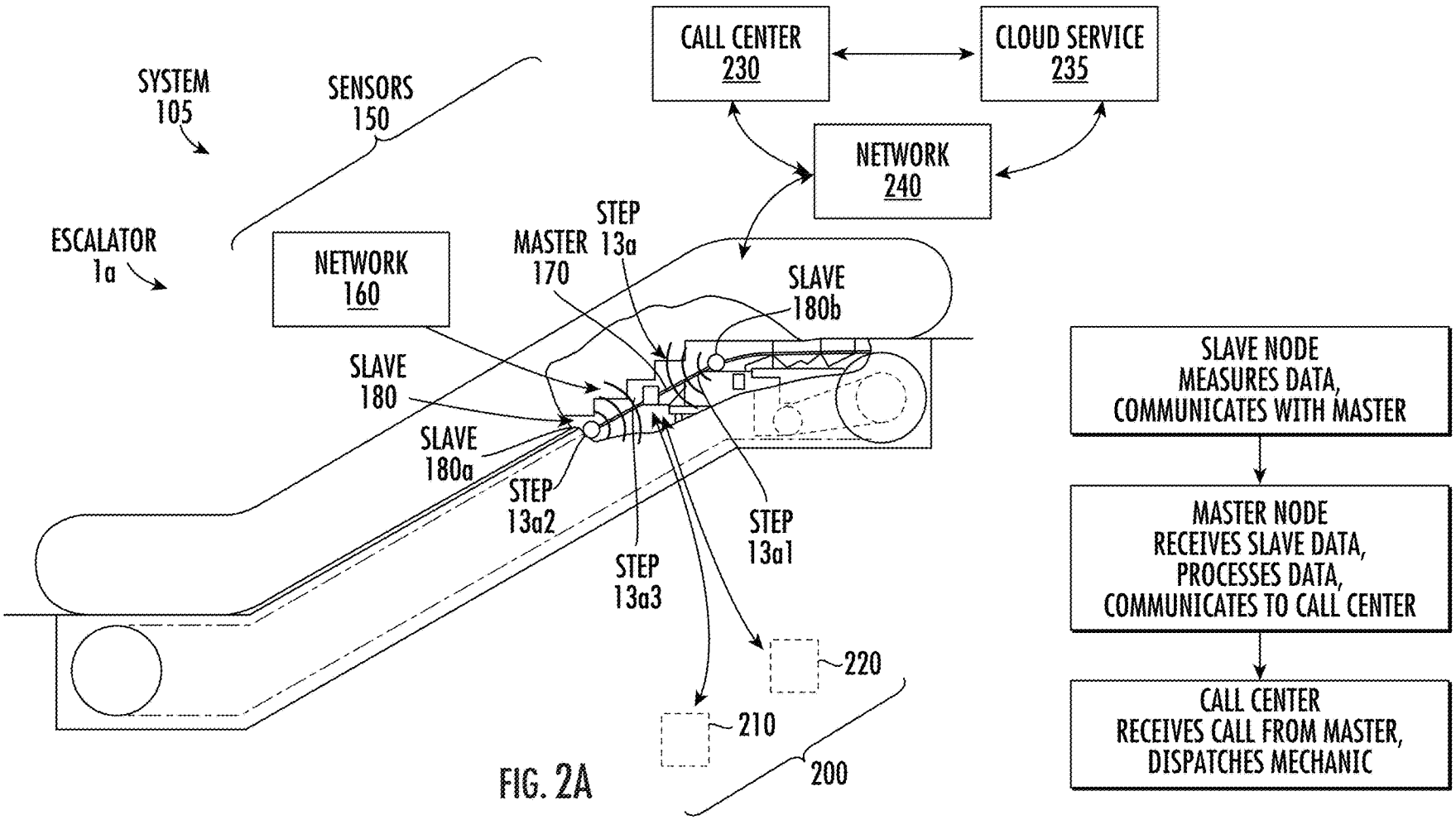
FIG. 2A shows an escalator system that is equipped with sensors according to an embodiment.
FIG. 2B shows a communication protocol executed by the escalator system according to an embodiment.

Turning to FIGS. 2A and 2B, the disclosed embodiments provide an escalator system 105 that is able to predict imminent faults and localize faults that occur, reducing maintenance times per fault and, for example, allowing a contractor to perform maintenance as needed.

The escalator system 105 includes a plurality of state sensors 150 on the escalator steps 13*a* of the escalator 1*a* that wirelessly communicate with each other to predict and localize imminent component failure. It is to be appreciated that the sensors 150 may be installed on every step, every other step, every third step, etc., that is, at any desired frequency. The state sensors 150 may include accelerometers, strain gages, video cameras, and microphones to record data. That is, the state sensors 150 are utilized to determine the physical and operational state of the escalator 1*a*.

The state sensors 150 of the escalator system 105 include a master sensor (or master pack) 170 and slave sensors (or slave sensor packs) 180*a*, 180*b* (the slave sensors are referred to generally as 180). The slave sensors 180 are distributed on different ones of the escalator steps 13*a*1, 13*a*2 (the escalator steps are referred to generally as 13*a*). The master sensor 170 may be located on one of the escalator steps 13*a*3 (as shown) or may be at a nearby location along or adjacent to the escalator 1*a*. The state sensors 150 may communicate among each other using a first network 160 that is a wireless network such as a personal area network (including but not limited to Bluetooth Wifi, Zigbee, Zwave) or similar networks.

The slave sensors 180 communicate with the master sensor 170. The master sensor 170 may be on a step 13*a* or may be at a fixed location nearby. Communications between the master 170 and slave sensors 180 may be substantially constant or the master sensor 170 may communicate with individual ones of the slave sensors 180 that are within a predetermined distance of the master sensor 170. The step-sensor pairings may be mapped, for example, from hardware addresses of the sensors. Thus, if a sensor senses an issue, the location of the issue may be readily determined.

The master sensor 170 may be configured for edge computing and include computer circuitry 200, including memory 210 and a processor 220. As shown in block 2B1 in FIG. 2B, the slave sensors (or slave nodes) 180 may measure data and communicate measured slave sensor data to the master sensor (or master node) 170.

As shown in block 2B2, the master sensor 170 may receive the slave sensor data via the first 160, processes the slave sensor data to obtain master sensor data and transmit the master sensor data to an escalator call center 230 via a second network 240. The second network 240 may be a wireless network, such as cellular or satellite network. Alternatively, if the master sensor 170 is in a fixed location, a landline connection may be utilized for at least a portion of the second network.

In addition, or as an alternate, the slave sensors 180 may also perform at least some on-board processing/analysis. For example, the slave sensors 180 may perform relatively basic tasks such as filtering sensor data and transmit high and/or low filtered data to the master sensor 170. In some embodiments the slave sensors 180 may perform an analysis of failures based on the sensor data, e.g., utilizing edge computing.

That is, the master sensor 170 is capable of saving fault data, performing data analytics (such as stress/strain and statistical analytics) on sensor signals received from the slave sensors 180. In addition, the master sensor data may, for example, identify the occurrence of a fault condition, include shut-down instructions, and include a service all request. In one embodiment, the master sensor 170 may transmit all of the master sensor data to a cloud service 235. For simplicity, the cloud service will be referred to as the cloud. As shown in block 2B3, the escalator call center 230 may receive the master sensor data and dispatch service. The master sensor 170 is configured to initiate a service call to the escalator call center 230, directly or through the cloud 235, e.g., via the second network 240 which is a cellular network or similar network.

With the state sensors 150 networked with each other, faults may be identified and localized (e.g., a location may be pinpointed) by performing data analytics on the slave sensor data. Alternatively, faults may be inferred by the master sensor 170 using sensor latency, e.g., using differing response times of the state sensors. Further, the processed data may be used by the master sensor 170 to determine if there is an overloading type fault condition on the escalator 1*a*, and to initiate an urgent stop before actual damage to the escalator system 105 is accrued. Utilizing the state sensors 150, the master sensor 170 may perform prognostics and health management, and condition based maintenance (CBM) on components.

Data analytics, including machine learning, may be performed on the master sensor 170 by using performance data from field or staged tests and measurements (empirically obtained) and simulations (analytically obtained) and their combination to infer a component state (e.g., component load paths, stress/strain states, and operational modes). The result is a health estimation for a greater number of components than may be instrumented, and/or a more thorough estimation on components utilizing less instrumentation.

In one embodiment, the empirically obtained data may be organized in look-up charts relating component loading, stress and strain. In one embodiment, the analytics may be based on, for example, a finite element analysis. The charts may be stored on, and analysis may be performed at, the master sensor 170, in real time, upon receiving slave sensor data.

The disclosed embodiments may also be utilized to infer conditions among different escalators without having to instrument each of the escalators. For example, after a disturbance such as an earthquake, the instrumentation readings on the escalator 1*a* equipped with the state sensors 150 may be used to identify issues that may occur on each of the escalators in a same bank, building or geographic region.

Benefits of the disclosed embodiments include real-time prognostics and diagnostics of components, leveraging of sensor data and diagnostics to reduce regularly scheduled maintenance, reducing on-site mechanic time and failed component rates, the ability to identify at a localized level a failed component, and the ability for an escalator 1*a* to self-shutdown, by operation of the master sensor 170, when an overloading type fault condition or other unacceptable condition occurs. Tracked data may be used to enhance future escalator designs for better performance/longer component life.

Figure 3:
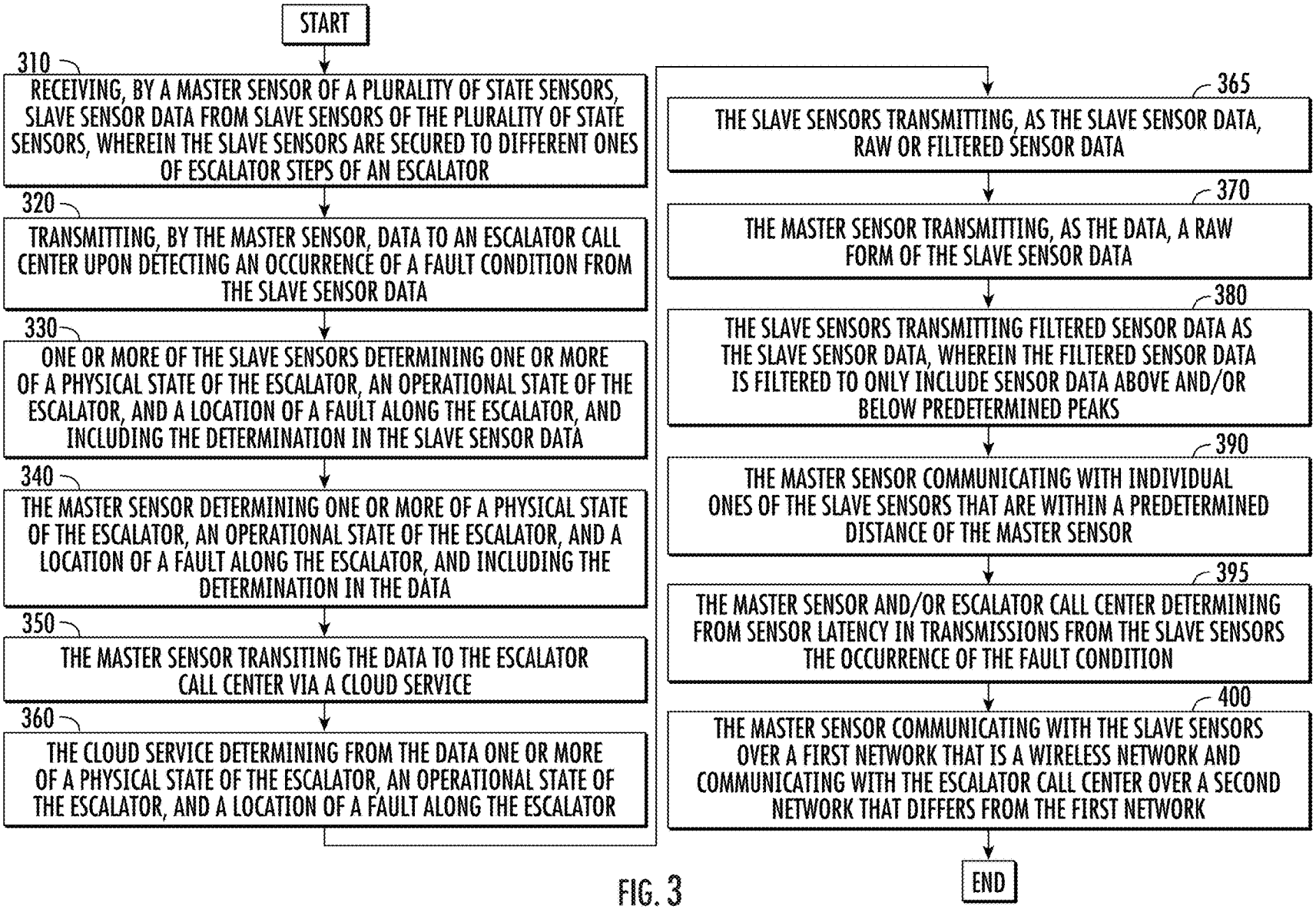
FIG. 3 is a flowchart showing a method of monitoring an escalator according to an embodiment.

Turning to FIG. 3, a flowchart shows a method of monitoring an escalator system 105. As shown in block 310, the method includes receiving, by the master sensor 170 of the state sensors 150, slave sensor data from slave sensors 180 of the state sensors 150. The slave sensor data may be raw or processed data. As indicated, the slave sensors 180 are secured to different ones of escalator steps 13*a* of the escalator 1*a*. As indicated, the master sensor 170 may also be secured to one of the escalator steps 13*a*. In one embodiment, the master sensor 170 may be in a fixed location on or near the escalator 1*a*. As indicated, the state sensors 150 may include one or more of an accelerometer, a strain gage, a video camera, and a microphone.

As shown in block 320, the method may also include transmitting, by the master sensor 170, an alert to the escalator call center 230 upon detecting the occurrence of a fault condition from the slave sensor data. In one embodiment, the master sensor 170 may transmit raw data to the escalator call center 230.

As shown in block 330, the method may also include one or more of the slave sensors 170 determining one or more of a physical state of the escalator 1*a*, an operational state of the escalator 1*a*, and a location of a fault along the escalator 1*a*, and including the determination in the slave sensor data. In addition, or as an alternative, as shown in block 340, the method may also include the master sensor 170 determining one or more of a physical state of the escalator 1*a*, an operational state of the escalator 1*a*, and a location of a fault along the escalator 1*a*, and including the determination in the data.

As shown in block 350, the method may also include the master sensor 170 transiting the data to the escalator call center 230 via a cloud service 235. As shown in block 360, the method may include the cloud service 235 determining from the data one or more of a physical state of the escalator 1*a*, an operational state of the escalator 1*a*, and a location of a fault along the escalator 1*a*.

As shown in block 365, the method may include the slave sensors 180 transmitting, as the slave sensor data, raw or filtered sensor data. As shown in block 370, the method may include the master sensor 170 transmitting, as the data, a raw form of the slave sensor data that it received from the slave sensors 180. As shown in block 380, the method may include the slave sensors 180 transmitting filtered sensor data as the slave sensor data. In one embodiment, the filtered sensor data is filtered to only include sensor data above and/or below predetermined peaks, e.g., such as provided through hardware or software bandpass filtering.

As indicated, the master sensor 170 is secured to a fixed location on or near the escalator 1*a*. As shown in block 390, the method may include the master sensor 170 communicating with individual ones of the slave sensors 180 that are within a predetermined distance of the master sensor 170. As shown in block 3950, the method may also include determining, by the master sensor 170, from sensor latency in transmissions from the slave sensors 180 the occurrence of the fault condition.

As shown in block 400, the method may also include communicating, by the master sensor 170, with the slave sensors over a first network 160 that is a wireless network. As shown in block 400, the method may also include communicating, by the master sensor 170, with the escalator call center 230 over a second network 240 that differs from the first network 160. As indicated, the first network 160 may be a personal area network and the second network 240 may be a cellular network.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An escalator system comprising:

escalator steps; and a plurality of state sensors including a master sensor and slave sensors, wherein the slave sensors are secured to different ones of the escalator steps, wherein the master sensor is configured to:

receive slave sensor data from the slave sensors; and transmit data to an escalator call center upon detecting an occurrence of a fault condition from the slave sensor data, wherein:

one or more of the slave sensors determines one or more of a physical state of the escalator, an operational state of the escalator, and a location of the fault condition along the escalator, and includes the determination in the slave sensor data; or the master sensor determines one or more of a physical state of the escalator, an operational state of the escalator, and a location of the fault condition along the escalator, and includes the determination in the data, wherein:

the master sensor transits the data to the escalator call center via a cloud service, and the cloud service determines from the data one or more of a physical state of the escalator, an operational state of the escalator, and a location of the fault condition along the escalator.

2. An escalator system comprising:

escalator steps; and a plurality of state sensors including a master sensor and slave sensors, wherein the slave sensors are secured to different ones of the escalator steps, wherein the master sensor is configured to:

receive slave sensor data from the slave sensors; and transmit data to an escalator call center upon detecting an occurrence of a fault condition from the slave sensor data, wherein:

one or more of the slave sensors determines one or more of a physical state of the escalator, an operational state of the escalator, and a location of the fault condition along the escalator, and includes the determination in the slave sensor data; or the master sensor determines one or more of a physical state of the escalator, an operational state of the escalator, and a location of the fault condition along the escalator, and includes the determination in the data, wherein:

the slave sensors transmit, as the slave sensor data, raw or filtered sensor data; and/or the master sensor transmits, as the data, a raw form of the slave sensor data.

3. The escalator system of claim 2, wherein:

the slave sensors transmit filtered sensor data as the slave sensor data, wherein the filtered sensor data is filtered to only include sensor data above and/or below predetermined peaks.

4. An escalator system comprising:

escalator steps; and a plurality of state sensors including a master sensor and slave sensors, wherein the slave sensors are secured to different ones of the escalator steps, wherein the master sensor is configured to:

receive slave sensor data from the slave sensors; and transmit data to an escalator call center upon detecting an occurrence of a fault condition from the slave sensor data, wherein:

the master sensor is secured to a fixed location on or near the escalator and communicates with individual ones of the slave sensors that are within a predetermined distance of the master sensor, wherein:

the master sensor and/or escalator call center is configured to:

determine from sensor latency in transmissions from the slave sensors the occurrence of the fault condition.

5. An escalator system comprising:

escalator steps; and a plurality of state sensors including a master sensor and slave sensors, wherein the slave sensors are secured to different ones of the escalator steps, wherein the master sensor is configured to:

receive slave sensor data from the slave sensors; and transmit data to an escalator call center upon detecting an occurrence of a fault condition from the slave sensor data, wherein:

the master sensor is configured to communicate with the slave sensors over a first network that is a wireless network and communicate with the escalator call center over a second network that differs from the first network.

6. A method of monitoring an escalator system comprising:

receiving, by a master sensor of a plurality of state sensors, slave sensor data from slave sensors of the plurality of state sensors, wherein the slave sensors are secured to different ones of escalator steps of an escalator;

transmitting, by the master sensor, a data to an escalator call center upon detecting an occurrence of a fault condition from the slave sensor data; and one or more of the slave sensors determining one or more of a physical state of the escalator, an operational state of the escalator, and a location of the fault condition along the escalator, and includes the determination in the slave sensor data; or the master sensor determining one or more of a physical state of the escalator, an operational state of the escalator, and a location of the fault condition along the escalator, and includes the determination in the data.

7. The method of claim 6, comprising:

the master sensor transiting the data to the escalator call center via a cloud service, and the cloud service determining from the data one or more of a physical state of the escalator, an operational state of the escalator, and a location of the fault condition along the escalator.

8. A method of monitoring an escalator system comprising:

receiving, by a master sensor of a plurality of state sensors, slave sensor data from slave sensors of the plurality of state sensors, wherein the slave sensors are secured to different ones of escalator steps of an escalator;

transmitting, by the master sensor, a data to an escalator call center upon detecting an occurrence of a fault condition from the slave sensor data; and the slave sensors transmitting, as the slave sensor data, raw or filtered sensor data; and/or the master sensor transmitting, as the data, a raw form of the slave sensor data.

9. The method of claim 8, comprising:

the slave sensors transmitting filtered sensor data as the slave sensor data, wherein the filtered sensor data is filtered to only include sensor data above and/or below predetermined peaks.

10. A method of monitoring an escalator system comprising:

receiving, by a master sensor of a plurality of state sensors, slave sensor data from slave sensors of the plurality of state sensors, wherein the slave sensors are secured to different ones of escalator steps of an escalator; and transmitting, by the master sensor, a data to an escalator call center upon detecting an occurrence of a fault condition from the slave sensor data, wherein:

the master sensor is secured to a fixed location on or near the escalator; and the method includes the master sensor communicating with individual ones of the slave sensors that are within a predetermined distance of the master sensor.

11. The method of claim 10, comprising:

the master sensor and/or escalator call center determining from sensor latency in transmissions from the slave sensors the occurrence of the fault condition.

12. A method of monitoring an escalator system comprising:

receiving, by a master sensor of a plurality of state sensors, slave sensor data from slave sensors of the plurality of state sensors, wherein the slave sensors are secured to different ones of escalator steps of an escalator;

transmitting, by the master sensor, a data to an escalator call center upon detecting an occurrence of a fault condition from the slave sensor data; and the master sensor communicating with the slave sensors over a first network that is a wireless network and communicating with the escalator call center over a second network that differs from the first network.

* * * * *